US007905122B2

(12) United States Patent
Murray et al.

(10) Patent No.: US 7,905,122 B2
(45) Date of Patent: Mar. 15, 2011

(54) METHOD AND SYSTEM FOR DETERMINING A WASHING MACHINE LOAD UNBALANCE

(75) Inventors: Peter Murray, West Yorkshire (GB); Michael I Henderson, St. Louis, MO (US); Darko Marcetic, St. Louis, MO (US); Joseph G Marcinkiewicz, St. Peters, MO (US); Vinodkumar Sadasivam, St. Louis, MO (US); Anandan Velayutham Rajarathnam, St. Louis, MO (US)

(73) Assignee: Nidec Motor Corporation, St. Louis, MO (US)

( * ) Notice: Subject to any disclaimer, the term of this patent is extended or adjusted under 35 U.S.C. 154(b) by 948 days.

(21) Appl. No.: 10/655,626

(22) Filed: Sep. 4, 2003

(65) Prior Publication Data

US 2004/0211009 A1 Oct. 28, 2004

Related U.S. Application Data

(60) Provisional application No. 60/466,106, filed on Apr. 28, 2003.

(51) Int. Cl.
*D06F 33/02* (2006.01)

(52) U.S. Cl. ..... 68/12.06; 68/12.02

(58) Field of Classification Search ..... 68/12.06
See application file for complete search history.

(56) References Cited

U.S. PATENT DOCUMENTS

| | | | | |
|---|---|---|---|---|
| 5,070,565 | A * | 12/1991 | Sood et al. | 8/159 |
| 5,161,393 | A * | 11/1992 | Payne et al. | 68/12.04 |
| 6,240,586 | B1 * | 6/2001 | Joo | 8/159 |
| 6,437,997 | B1 * | 8/2002 | Inarida et al. | 363/37 |
| 2001/0054204 | A1 * | 12/2001 | Ciancimino et al. | 8/159 |
| 2002/0016997 | A1 * | 2/2002 | Jonsson | 8/159 |
| 2003/0000262 | A1 * | 1/2003 | Bruce et al. | 68/12.06 |
| 2003/0188389 | A1 * | 10/2003 | Sears | 8/159 |
| 2004/0211009 | A1 | 10/2004 | Murray et al. | |

FOREIGN PATENT DOCUMENTS

DE 3736809 A1 * 10/1987

(Continued)

OTHER PUBLICATIONS

Athina Nickitas-Etienne, International Preliminary Report On Patentability, Nov. 14, 2007, The International Bureau of WIPO, Switzerland.

(Continued)

*Primary Examiner* — Michael Barr
*Assistant Examiner* — Jason P Riggleman
(74) *Attorney, Agent, or Firm* — Locke Lord Bissell & Lidell LLP

(57) ABSTRACT

A clothes washing machine system including a method of detecting a load unbalance. The washing machine system includes a cabinet having a drum rotatably mounted therein. A motor is coupled to the drum for rotating the drum within the cabinet. A memory device is accessible by a processor, such as a digital signal processor (DSP). The memory contains program code for implementing a method that includes determining the motor torque ripple, determining the motor speed, and determining the load unbalance mass based on the motor torque and speed.

15 Claims, 6 Drawing Sheets

FOREIGN PATENT DOCUMENTS

| | | | | |
|---|---|---|---|---|
| EP | 0394177 | A2 | | 10/1990 |
| EP | 0657576 | A1 | | 6/1995 |
| EP | 1167610 | A2 | | 1/2002 |
| EP | 1045062 | | | 12/2003 |
| GB | 2001454 | A | * | 1/1979 |
| JP | 4314496 | | * | 11/1992 |

OTHER PUBLICATIONS

Ekkehard Weinberg, Written Opinion Of The International Searching Authority, Nov. 14, 2007, European Patent Office, Germany.

English Abstract of EP0657576 entitled "Automatically Controlled Washing Machine.", Published Jun. 14, 1997.

* cited by examiner

METHOD AND SYSTEM FOR DETERMINING A WASHING MACHINE LOAD UNBALANCE

CROSS REFERENCE TO RELATED APPLICATION

This application claims the benefit of U.S. Provisional Patent Application No. 60/466,106, filed on Apr. 28, 2003, which is incorporated by reference herein.

BACKGROUND OF THE DISCLOSURE

1. Field of the Disclosure

The present invention relates generally to clothes washing machines, and more particularly, to a method and system for detecting and quantifying an unbalance mass in a washing machine drum.

2. Description of Related Art

Residential and commercial clothes washing machines are well known. A generally cylindrical drum or basket for holding the clothing and other articles to be washed is rotatably mounted within a cabinet. Typically, an electric motor drives the drum. During a wash cycle, water and detergent or soap are forced through the clothes to wash them. The detergent is rinsed from the clothes, then during one or more spin cycles the water is extracted from the clothes by spinning the drum.

One way of categorizing washing machines is by the orientation of the washing machine drum. Vertical-axis washing machines have the drum situated to spin about a vertical axis. Articles to be washed are loaded into the drum through a door, which is usually situated on the top of the washing machine. A vertical-axis washing machine drum includes an agitator situated therein, which cleans clothes by pushing and pulling them down into the water. A motor typically drives the agitator, in addition to spinning the vertically-oriented drum during spin cycles. The motor usually operates at a constant speed, and a series of gears or belts are configured to drive the proper component at the proper time during each washing machine cycle.

Horizontal-axis washing machines, having the drum oriented to spin about an essentially horizontal axis, do not include an agitator, and a variable-speed motor drives the drum. During wash cycles, the drum of the horizontal-axis washing machines rotates at a relatively low speed. The rotation speed of the drum is such that clothes are lifted up out of the water, using baffles distributed about the drum, then dropped back into the water as the drum revolves.

Both vertical and horizontal-axis washing machines extract water from clothes by spinning the drum, such that centrifugal force extracts water from the clothes. It is desirable to spin the drum at a high speed and extract the maximum amount of water from the clothes in the shortest possible time. Spin time is reduced, but more power is required to spin at a higher speed. The distribution of the clothes about the periphery of the drum affects the washing machine's ability to spin the drum at a high speed.

If the clothes in the drum are not distributed evenly, the drum will not be able to rotate at an acceptable spin speed without excessive drum vibration in the cabinet. Several factors contribute to drum load unbalance problems. For instance, with vertical-axis washing machines, when a wash or rinse cycle completes and the water is drained from the drum, the clothes are gathered at the bottom of the drum, and are not evenly distributed about the entire drum. Moreover, the drum typically is not perfectly cylindrical; but rather, includes a draft. When the drum spins, the clothes will "creep" up the sides of the drum. However, since a constant speed motor typically drives the vertically-oriented drum, the motor quickly ramps the drum up to the full spin speed. There is little chance for the clothes to distribute about the periphery of the drum, so they creep up the drum's sides in an unbalanced fashion.

The unbalanced, spinning drum vibrates within the cabinet. In conventional vertical-axis washing machines, if the vibration is too severe, the drum will trip a switch mounted inside the cabinet, stopping the drum's rotation and activating a drum-unbalance alarm. A user then manually redistributes the wet clothes within the drum, and restarts the spin cycle.

As discussed above, the drum in a horizontal-axis machine is driven by a variable speed motor. This allows the inclusion of a "distribution" cycle, wherein the drum is rotated faster than the rotation speed of a wash cycle, but slower than in a spin cycle. The drum rotation speed is gradually increased, until the clothes begin to "stick" to the sides of the drum due to centrifugal force. The slower rotation speed allows the clothes to more evenly distribute about the sides of the drum. Once the clothes have been distributed about the drum, the speed is increased to a full spin speed to extract the water from the clothes.

Horizontal-axis washing machines, however, are not immune to drum unbalance problems. If the clothes do not evenly distribute during the distribution cycle, the unbalanced load within the drum will cause unwanted vibrations as the drum rotates. Rather than applying all of the motor's power to spinning the drum at the highest possible speed, power is wasted in drum movement and cabinet vibrations. Detecting the amount of load unbalance allows the spin speed to be optimized to give an efficient wash, while at the same time minimizing the vibrations caused by centrifugal unbalance forces. In cases where the amount of unbalance detected is very high, the washing machine can be programmed to stop its spin cycle, shake the drum to redistribute the washing, and then restart the spin cycle.

Thus, it is desirable to detect the presence and the amount of an unbalance condition in a rotating drum to optimize spin speed and/or take corrective action when necessary. However, prior art methods for detecting unbalance conditions have been largely unsatisfactory. The present invention addresses these, and other, shortcomings associated with the prior art.

SUMMARY OF THE DISCLOSURE

In one aspect of the present invention, a clothes washing machine system implements a method of detecting a load unbalance. The washing machine system includes a cabinet having a drum rotatably mounted therein. A motor is coupled to the drum for rotating the drum within the cabinet. A memory device is accessible by a processor, such as a digital signal processor (DSP). The memory device and processor may be separate devices or alternatively the memory device may be embedded with the processor itself, as is the case with a microcontroller. The memory contains program code for implementing a method that includes determining the motor torque ripple, determining the motor speed, and determining the load unbalance mass based on the motor torque and speed.

The motor torque ripple may be determined by measuring the motor voltage and current. In exemplary embodiments, a mathematical model of the washing machine drum load is developed that describes the relationship between motor torque and the unbalance mass. Model coefficients are determined using a parameter estimator, such as a recursive least squares estimator, and from these coefficients the unbalance mass can be obtained.

Acceleration and the angular position of the drum may be calculated based on the drum speed and vice versa. In accordance with other aspects of the invention, the motor is operated to drive the drum at a predetermined speed, at which the drum movement on its suspension is minimal. This allows the use of a fixed axis model of the system.

BRIEF DESCRIPTION OF THE DRAWINGS

Other objects and advantages of the invention will become apparent upon reading the following detailed description and upon reference to the drawings in which.

Figure 1:
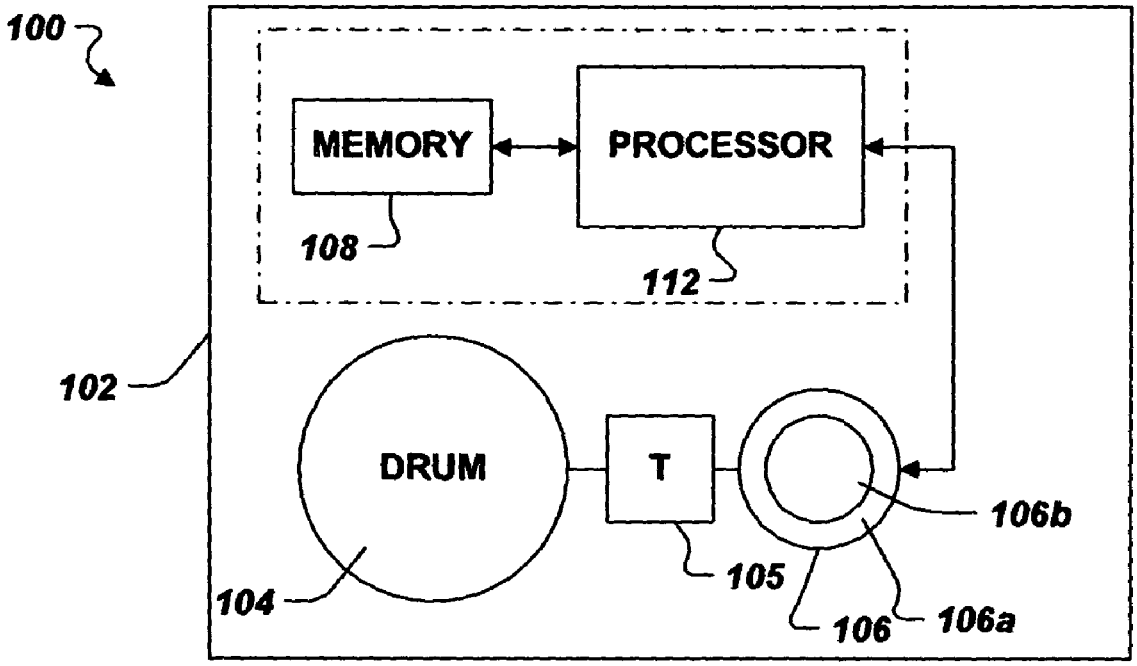
FIG. 1 is a block diagram of a washing machine system in accordance with aspects of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
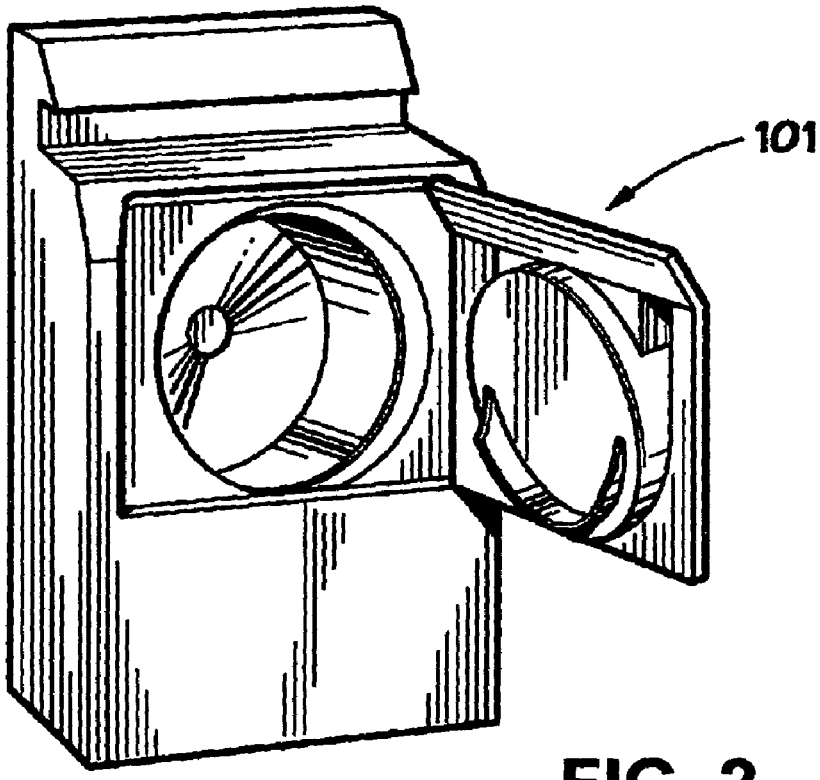
FIG. 2 is a perspective view of an exemplary horizontal-axis washing machine.

FIG. 1 is a block diagram, schematically illustrating a washing machine 100 in accordance with an embodiment of the present invention. The washing machine 100 includes a cabinet 102, in which a drum 104 is rotatably mounted. In one embodiment of the invention, the washing machine 100 is a horizontal-axis washing machine. In other words, the drum 104 is configured to rotate about a substantially horizontal axis within the cabinet 102. FIG. 2 illustrates a horizontal-axis washing machine 101 in accordance with a specific embodiment of the invention.

Referring back to FIG. 1, a motor 106 is operably connected to the drum 104 to drive the drum 104, via some transmission system 105 which could be a belt drive, clutch or direct coupling, for example. The motor 106 includes a stator 106*a* and a rotor 106*b* situated to rotate relative to the stator 106*a*. Any suitable motor type may be employed, including an induction motor, a brushless permanent magnet motor (BPM), a switched reluctance (SR) motor, etc. In one particular exemplary embodiment, a three-phase controlled induction motor (CIM) is used. A processing device 112 controls operation of the motor 106, and a memory device 108 is accessible by the processor 112. The processor 112 may comprise, for example, any suitable type of digital processor such as a digital signal processor (ASP), microcontroller or microprocessor.

Figure 3:
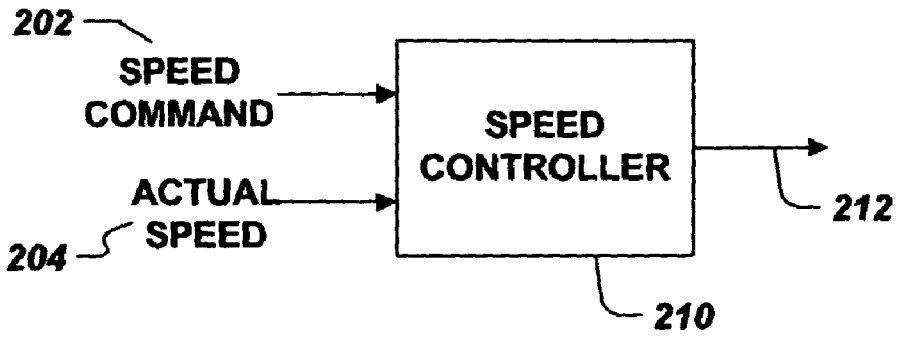
FIG. 3 is a block diagram illustrating an exemplary speed control loop.

The memory 108 stores program instructions executed by the processor 112 for controlling operation of the washing machine system 100. Among other things, the processor 112 is programmed to control the speed of the motor 106 and thus, the drum 104. A typical speed control loop 200 is shown in FIG. 3. A speed command signal 202 and a signal 204 indicating the actual speed of the rotor 106*b* are applied to a speed controller 210, such as a proportional/integral (PI) controller. The speed controller 210 compares the speed demand signal 202 and the actual speed signal 204 to calculate a speed error, and in response thereto, outputs a control signal 212 that varies the application of power to the motor to achieve the desired speed.

Speed/position detection and control of the rotor 106*b* may be implemented, for example, based on feedback from a tachometer on the motor shaft. In other washing machine systems embodying aspects of the present invention, position/speed of the rotor 106*b* is calculated or estimated from monitored parameters of the motor 106, such as the motor's voltage and current. These systems are often called "sensorless" systems since they do not use a physical transducer to determine the position and or speed. In such sensorless systems, the processor 112 receives indications of the motor current and voltage, and an algorithm stored in the memory 108 determines the position/speed of the rotor 106*b* based thereon.

As discussed in the Background section herein above, washing machines typically include a variety of operation cycles. Washing machines—particularly horizontal-axis machines—include one or more wash cycles, distribution cycles and spin cycles. Drum unbalance is rarely a significant problem during wash cycles, which, in a horizontal-axis machine, use a drum rotation speed of about 50 rpm to tumble the clothes in and out of the water. Distribution cycles typically operate at a drum rotation speed of about 55-110 rpm (clothes will begin to "plaster" or "stick" to the sides of the drum 104 at one G of centrifugal force).

In comparison, the minimum rotation speed that is normally considered a "spin cycle" speed is about 250 rpm. For example, a drum rotation speed of about 350-450 may be considered a "low" spin speed, a drum rotation speed of about 650-850 may be considered a "medium" spin speed, and a drum rotation speed of about 1,000 rpm may be considered a "high" spin speed. As discussed above, it is desirable to rotate the drum 104 at a high speed to extract the maximum amount of water from the clothes in the shortest possible time.

Detecting the amount of a load unbalance allows the spin speed to be optimized to give an efficient wash, while at the same time minimizing the vibrations caused by centrifugal unbalance forces. Accordingly, the memory 108 includes program code that when executed by the processor, implements methods to determine an unbalance mass in the rotating drum 104.

Figure 4:
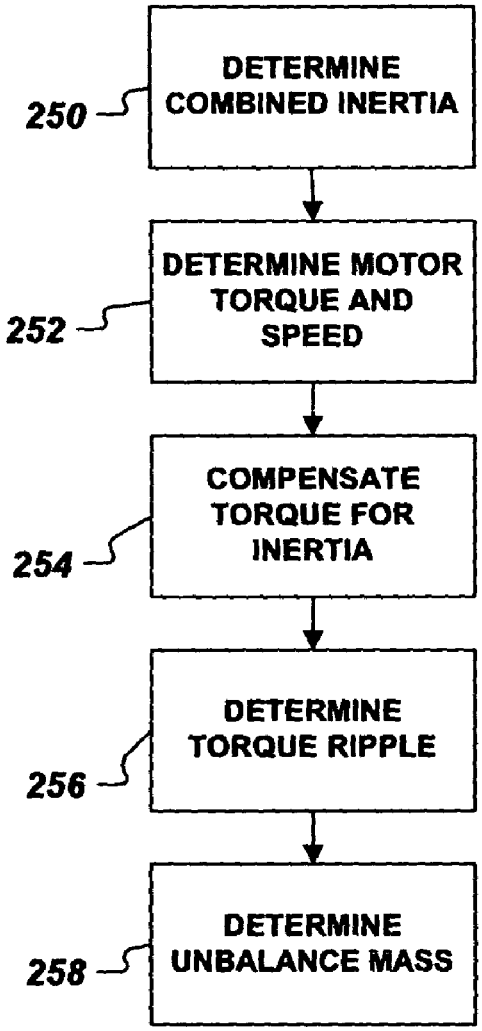
FIG. 4 is a flow diagram summarzing a method of determining an unbalance mass in accordance with the present invention.

An exemplary method for determining the unbalance mass is summarized in FIG. 4. The unbalance mass is determined based on a determination of the motor torque and speed ripple. A measure of the amount of unbalance is determined by using a parameter estimator, such as a recursive least squares (RLS) parameter estimator to calculate the amount of torque ripple. The relationship between torque ripple and unbalance mass is known by constructing a model of the drum load. In certain embodiments, a sensorless motor is employed, in which the motor speed and motor torque are calculated from terminal measurements of the motor's voltage and current. Alternatively, other instrumentation may be used, such as a tachometer, to determine speed.

In block 250 of FIG. 4, the combined drum and wash inertia is estimated. Inertia estimation schemes are described further below. Once the combined inertia has been estimated the motor is commanded to run at a steady speed, which is set such that plastering occurs with minimal movement of the drum on its suspension. As indicated in block 252, the motor torque and speed variables are then read. Other system variables such as acceleration and position can be determined from the motor speed. Additionally, all motor variables can be referred to the drum using a model of the transmission system.

In block 254 the inertial torque caused by any speed ripple is subtracted from the overall torque, which ensures that the remaining torque ripple is due entirely to gravity acting on the unbalanced mass. The inertial torque ripple is calculated from the inertia calculated in block 250 and the speed.

The drum position and compensated torque are then fed into a parameter estimator, which gives an estimate of the torque ripple in block 256. Blocks 252, 254 and 256 are repeated at a plurality of sampling points until the torque ripple estimate converges to a steady value, typically within five drum cycles. In block 256, the unbalance mass is determined based on the torque ripple. The method summarized in FIG. 4 is described in further detail below.

Figure 5:
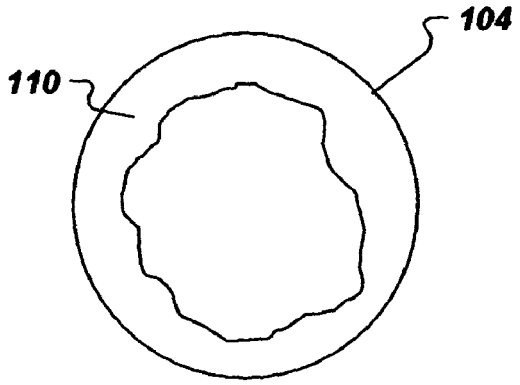
FIG. 5 illustrates laundry distribution in a washing machine drum.
Figure 6:
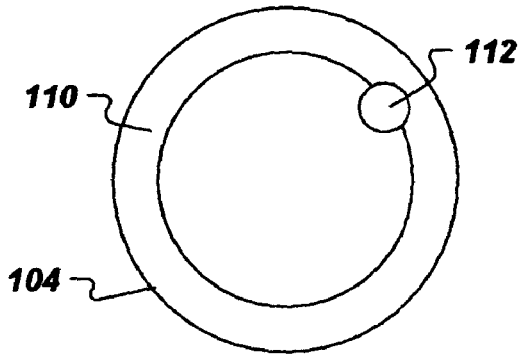
FIG. 6 illustrates laundry distribution including a point mass unbalance in a washing machine drum.

During the washing machine distribution cycle the laundry gets plastered around the periphery of the drum 104 in a random, and essentially unpredictable, manner. The distribution of the laundry 110 will invariably be uneven as shown in FIG. 5. However, the effect of an unevenly distributed wash load on the system is actually equivalent to that of an evenly distributed wash load with a point mass unbalance. Thus, for purposes of this disclosure, the wash load 110 is assumed to be evenly distributed with a point mass unbalance 112 as shown in FIG. 6.

In accordance with aspects of the present invention, a mathematical model of the washing machine system is constructed. Thus, in order to detect drum unbalance it is necessary to identify the system variables that will be affected by drum unbalance. As noted above, these variables include drum/motor torque and drum/motor angular velocity. When unbalance is present, the drum/motor torque and angular velocity have a cyclically varying component at drum frequency (there may be some higher frequency components as well but these are essentially the result of second order effects). The amplitude of this cyclically varying component, or ripple, gives a measure of the amount of unbalance present. The added advantage of using these variables to detect unbalance is that both can be estimated using sensorless control, thus eliminating the need for measurement instrumentation.

Accordingly, the dynamic model of the washing machine drum system obtained contains variables such as torque and speed as well as acceleration and drum position, which can be determined from speed and vice versa. The coefficients of the variables in the dynamic model are composite of various system parameters such as unbalance mass, drum inertia and friction coefficients.

Assuming that the variables of the dynamic model can be obtained by sensorless techniques, or even by using onboard instrumentation, a parameter estimator can be employed to determine the coefficients of the variables and hence the required system parameters such as unbalance mass. A suitable parameter estimator for this purpose is a recursive least squares (RLS) estimator.

There is a certain amount of unbalance inherent in an empty drum 104, so the equivalent point mass unbalance 112 will be that of both the empty drum 104 and the laundry 110 combined. There is no advantage in trying to separate drum unbalance 112 from the laundry 110 unbalance because it is both of these unbalances acting together that ultimately results in the observed vibrations of the washing machine.

An exemplary process of constructing the dynamic model of the drum 104 in accordance with one embodiment of the invention is further detailed herein. The first stage in constructing such a model of the drum is to assume that the axis of rotation of the drum is fixed—the drum suspension is ignored. The fixed axis model is then developed in three steps: the first step is to assume that the axis of the drum is horizontal and that drum friction and drag losses are zero; the second step is to include the effects of friction and drag; and finally the third step is to include drum inclination.

Figure 7:
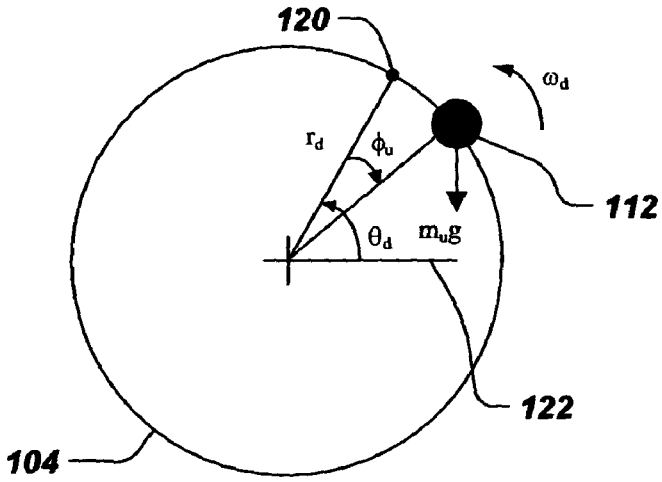
FIG. 7 conceptually illustrates the point mass unbalance in the washing machine drum.

FIG. 7 shows the point mass unbalance 112 on the periphery of the drum 104, which is turning at some angular velocity $\omega_d$. Although the unbalance mass 112 in FIG. 7 is shown to act at the drum radius $r_d$, it will not be assumed that this is always the case, because any distributed laundry will affect the location of the unbalance mass with respect to the center of the drum. The variable $r_u$ is therefore used in the calculations detailed herein to denote the radial distance of the unbalance mass 112 from the center of the drum 104.

Drum position $\theta_d$ is measured in a counterclockwise direction between a reference point 120 on the drum 104 and a fixed datum 122, which is arbitrarily chosen to be at 3 o'clock. The location of the point mass unbalance 122 is given by $\phi_u$ with respect to the drum reference point 120 in a clockwise direction. The position of the point mass unbalance 112 with respect to the fixed datum 122 is therefore $(\theta_{-\phi u})$. FIG. 7 additionally shows the force on the unbalance mass 112 due to gravity $m_u g$.

Assuming for the moment that there are no friction and drag losses associated with the drum 104, the drum torque $\tau_d$ in the direction of motion is given by:

$$\tau_d = m_u \cdot g \cdot r_u \cdot \cos(\theta_d - \phi_u) + J_d \cdot p(\omega_d) \quad (1)$$

where $J_d$ is the combined inertia of the drum and the unbalance mass and p is a differential operator, d/dt.

It can be seen from Equation 1 that if the velocity $\omega_d$ were constant, i.e. uniform circular motion, the drum torque $\tau_d$ would vary cyclically with a mean value of zero. Therefore, for the fixed speed case Equation 1 reduces to:

$$\tau_d = m_u \cdot g \cdot r_u \cdot \cos(\theta_d - \phi_u)$$

In practice there will be some variation in drum velocity $\omega_d$, depending upon the response of the system's speed controller 210 implemented by the processor 112. If the response of the speed controller 210 is very sluggish, the torque $\tau_d$ will be constant and zero. Therefore, for the fixed (and zero) torque case Equation 1 reduces to:

$$-m_u \cdot g \cdot r_u \cdot \cos(\theta_d - \phi_u) = J_d \cdot p(\omega_d)$$

Figure 8:
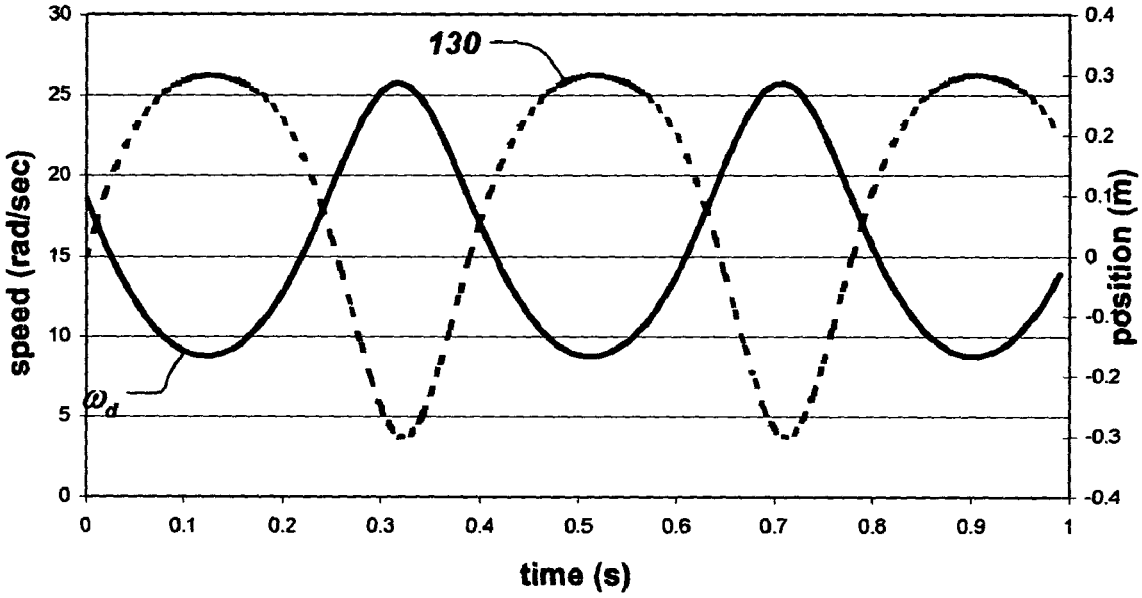
FIG. 8 is a graph illustrating washing machine drum velocity variation with time and the position of an unbalance mass with respect to the center of the drum.

FIG. 8 shows the drum velocity $\omega_d$ variation with time, along with the vertical (y-axis) position 130 of the unbalance mass 112 with respect to the center of the drum 104. The parameters used to obtain these curves were as follows: unbalance mass $m_u$=0.5 kg; $r_u$=0.3 m; $\omega_{d(initial)}$=20 rad/s; $J_d$=0.01 kgm$^2$. These parameters are not necessarily representative of an actual drum with unbalance. Rather, they were chosen for illustrative purposes only. It can be seen that the unbalance mass 112 moves quickly through its nadir, and slowly as it passes through its zenith.

As the mean velocity of the drum $\omega_d$ increases, the magnitude of the speed ripple decreases—as can be seen by considering the energy system:

$$m_u \cdot g \cdot 2 \cdot r_u = \tfrac{1}{2} \cdot J_d \cdot (\omega_{d(max)}^2 - \omega_{d(min)}^2)$$

where the left side of the equation is the potential energy gained due to gravity in moving the unbalanced mass 112 from the bottom to the top of the drum 104. The right side is the gain in kinetic energy in accelerating the unbalance mass 112 from $\omega_{d(min)}$ to $\omega_{d(max)}$ where $\omega_{d(min)}$ is the angular velocity of the drum 104 when the unbalance mass 112 is at the top of the drum 104 and $\omega_{d(max)}$ is the angular velocity of the drum 104 when the unbalance mass 112 is at the bottom of the drum 104.

In practice, both torque and velocity will vary, and so the observed behavior of the system will lie somewhere between the two extremes outlined above. The amount of torque and speed ripple will depend upon the response of the speed control loop 200, which in turn usually depends upon the proportional and integral gains of the speed controller 210. Therefore, the two cases considered are not appropriate for developing the system model, so the general equation given by Equation 1 is used from here onwards. However, it is important to consider the two extremes to understand that speed and torque ripple are affected by the response of the speed loop, and not just the unbalance mass 112.

In practice, a certain amount of torque is required to keep the drum running at a given speed in order to overcome forces due to drum friction and wind drag. Two types of friction will be considered: coulomb and viscous friction. Coulomb friction is a constant and is therefore independent of speed, although its polarity depends on the direction of rotation of the drum. Viscous friction, on the other hand, is proportional to the angular velocity of the drum. Both of these frictional forces take into account the resistance to motion due to the bearings, lubrication and wind drag, where the latter is assumed to be a type of viscous friction.

The coulomb friction is given by $\tau_c \text{signum}(\omega_d)$, where $\text{signum}(\omega_d)$ denotes that its polarity is the same as that of the drum's angular velocity, and the viscous friction is given by $B_d \cdot \omega_d$, where $B_d$ is the drum's viscous friction coefficient. Expanding Equation 1 to include these frictional forces gives:

$$\tau_d = m_u \cdot g \cdot r_u \cdot \cos(\theta_d - \phi_u) + J_d \cdot p(\omega_d) + B_d \cdot \omega_d + \tau_c \text{signum}(\omega_d) \quad (2)$$

Figure 9:
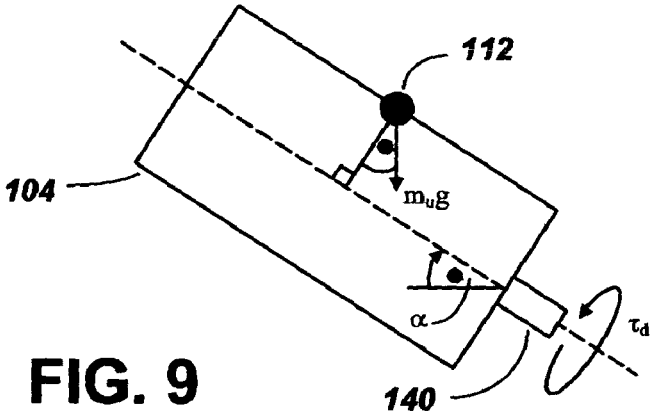
FIG. 9 is a side view of a washing machine the drum inclined relative to the horizontal.

The drum 104 in some versions of "horizontal" axis washing machines is not actually horizontal, but rather, is inclined at some angle to the horizontal. FIG. 9 shows a side view of the drum 104 inclined at an angle $\alpha$ to the horizontal. The gravitational force acting on the unbalanced mass 112 is $m_u g$. However, because the drum 104 is inclined at an angle a to the horizontal, the force perpendicular to the shaft 140 is given by:

$$\text{Force} = m_u \cdot g \cdot \cos(\alpha)$$

Figure 10:
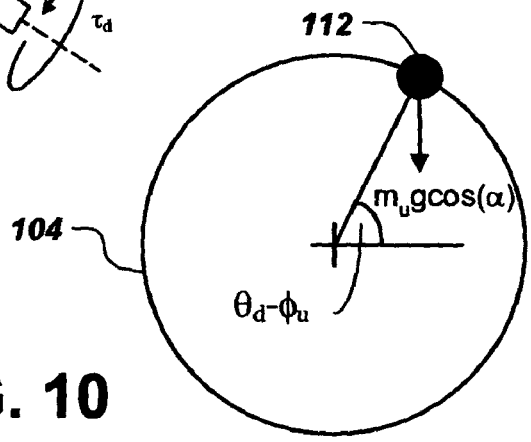
FIG. 10 illustrates the washing machine and point mass unbalance shown in FIG. 7, including the effects of drum inclination.

The drum 104 illustrated in FIG. 7 is redrawn in FIG. 10 to include the effects of drum inclination as shown in FIG. 9.

Equation 2 can now be modified to include drum inclination as follows:

$$\tau_d = m_u \cdot g \cdot r_u \cdot \cos(\alpha) \cdot \cos(\theta_d - \phi_u) + J_d \cdot p(\omega_d) + B_d \cdot \omega_d + \tau_c \cdot \text{signum}(\omega_d) \quad (3)$$

Note that if $\alpha$=90°, the gravitational force on the unbalance mass 112 acts along the axis of the shaft 140 and therefore has no effect on shaft torque.

Figure 11:
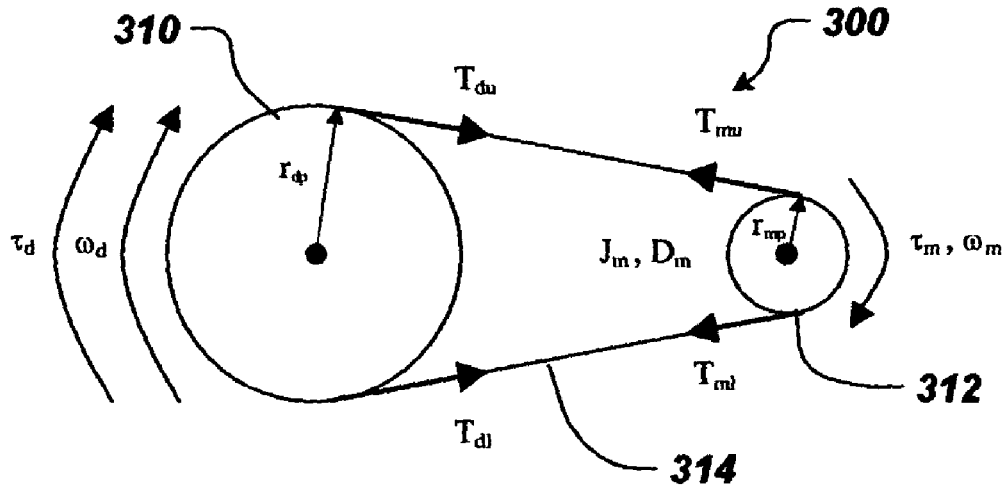
FIG. 11 conceptually illustrates a belt and pulley transmission system for driving a washing machine drum.

Referring back to FIG. 1, a motor 106 is operably connected to the drum 104 to drive the drum via a transmission system 105. In order to refer system variables, such as torque and speed, between the motor and drum, it is necessary to construct a model of the transmission system 105. FIG. 11 conceptually illustrates portions of a typical belt and pulley transmission system 300 for driving a washing machine drum. The transmission system 300 includes a drum pulley 310 connected to a motor pulley 312 by a belt 314.

In developing the unbalance detection system, assumptions for the washing machine transmission 300 system include the following:

1. The top or bottom of the belt 314 is either fully tensioned or fully slack.
2. The belt 314 does not appreciably slip.
3. There is no belt 314 compliance, i.e. the belt 314 does not stretch.
4. There is no backlash.

Based on FIG. 11, the electro-dynamic equation for the motor is as follows:

$$\tau_m = J_m \cdot p(\omega_m) + B_m \cdot \omega_m + (T_{mu} - T_{ml}) \cdot r_{mp} \quad (4)$$

where $J_m$ is the motor pulley 312 inertia, $B_m$ is the motor viscous friction coefficient, $T_{mu}$ and $T_{ml}$ are the upper and lower belt tension, respectively, at the motor pulley 312, $r_{mp}$ is the radius of the motor pulley 312, and $\omega_m$ is the motor shaft speed. The torque applied to the drum pulley 310, $\tau_d$, is given by:

$$\tau_d = (T_{du} - T_{dl}) \cdot r_{dp} \quad (5)$$

where $T_{du}$ and $T_{dl}$ are the upper and lower belt tension, respectively, at the drum pulley 310 and $r_{dp}$ is the radius of the drum pulley 310. As noted above in assumption 2, it is assumed that the top or bottom of the belt 314 is either fully tensioned or fully slack. This leads to the following:

$$T_{ml} = T_{dl} = 0 \quad (6)$$

$$T_{mu} = T_{du} \quad (7)$$

Therefore, combining Equations 4 and 5 gives:

$$\tau_d = \frac{r_{dp}}{r_{mp}} (\tau_m - J_m \cdot p(\omega_m) + B_m \cdot \omega_m) \quad (8)$$

Assuming a perfect transmission system, the drum speed and motor speed are related as follows:

$$\omega_m = \frac{r_{dp}}{r_{mp}} \cdot \omega_d \tag{9}$$

Equation 8 can therefore be written in terms of drum speed as follows:

$$\tau_d = \frac{r_{dp}}{r_{mp}} \cdot \tau_m - \left(\frac{r_{dp}}{r_{mp}}\right)^2 \cdot (J_m \cdot p(\omega_d) + B_m \cdot \omega_d) \tag{10}$$

From the fixed axis model, it can be seen that $\tau_d$ contains the terms $J_d \cdot p(\omega_d)$ and $B_d\omega_d$, which are similar to the inertial and viscous terms as those in Equation 10. The drum and motor inertial and viscous terms combine to give:

$$\left(J_d + \left(\frac{r_{dp}}{r_{mp}}\right)^2 \cdot J_m\right) \cdot p(\omega_d)$$

and $$\left(B_d + \left(\frac{r_{dp}}{r_{mp}}\right)^2 \cdot B_m\right) \cdot \omega_d$$

Now, if $$J_d >> \left(\frac{r_{dp}}{r_{mp}}\right)^2 \cdot J_m \text{ and } B_d >> \left(\frac{r_{dp}}{r_{mp}}\right)^2 \cdot B_m,$$

Equation 10 simply reduces to:

$$\tau_d = \frac{r_{dp}}{r_{mp}} \cdot \tau_m \tag{11}$$

The fixed axis model given by Equation 3 is referred to the drum, i.e. torque and speed are both drum quantities. However, it is more likely that the torque and speed variables that form the input to the model will be motor quantities, so Equations 9 and 11 will be required to refer motor speed and torque to the drum.

In order for the fixed axis model to be valid, the drum must not move significantly on its suspension. Therefore when using this model unbalance detection must be carried out when the drum is above minimum plaster speed, but less than the speed at which the suspension has a significant impact. Accordingly, in embodiments of the invention, the drum is run at a predetermined speed, such as 100 rpm, for some time period while the unbalance detection is implemented. Even if the drum is commanded to run at a predetermined constant speed, there will be some speed ripple that will result in a small amount of torque ripple due to the viscous friction term, $B_d$. However, if this torque ripple component is assumed negligible and the speed is otherwise substantially constant, the fixed axis model given by Equation 3 reduces to:

$$\tau_d = m_u \cdot g \cdot r_u \cdot \cos(\alpha) \cdot \cos(\theta_d - \phi_u) + J_d \cdot p(\omega_d) + \tau_{mean} \tag{12}$$

In order for a unique set of parameters to be estimated for the fixed axis system, the input signal must be sufficiently exciting. This requirement will be met if the input signal excites all modes of the system; such a signal is said to be "persistently exciting." For the system considered here, the input signal is effectively the drum speed, $\omega^d$, as the other variables, i.e. $\theta_d$ and $p(\omega_d)$, are themselves determined by the drum speed and vice versa.

During unbalance detection the drum will be commanded to run at a constant speed. If the actual drum speed is perfectly constant during this time there will be no angular acceleration of the drum, i.e. $p(\omega_d)=0$. Under this mode of operation the inertia has no effect on the drum torque so it would not be possible for the parameter estimator to get an estimate of the drum inertia, $J_d$. However, in practice the speed controller 210 will not be capable of regulating the drum speed to a perfectly constant value and there will be some speed variation of the drum about the commanded speed 202.

Test results show that, at speeds pertaining to a fixed axis system, the speed ripple is approximately sinusoidal at a frequency corresponding to drum speed. At small levels of speed ripple, the unbalance torque will be approximately sinusoidal because $\cos(\omega_d \cdot t - \phi_u) \approx \cos(\overline{\omega}_d \cdot t - \phi_u)$, where $\overline{\omega}_d$ is the mean speed. This causes a problem because when the frequency of the speed ripple is the same as the mean drum speed, the inertial torque will be sinusoidal at the same frequency as the unbalance torque. Under these circumstances numerous combinations of $J_d$, $m_u$ and $\phi_u$ will result in a small estimator error and as such, the estimator may have difficulty in uniquely identifying the inertial and unbalance torque components from the overall drum torque (At larger values of speed ripple this becomes less of a problem because $\cos(\omega_d \cdot t - \phi_u) \neq \cos(\overline{\omega}_d \cdot t - \phi_u)$ and so the unbalance torque contains harmonic components, whereas the inertial torque is still sinusoidal. The parameter estimator can then more easily distinguish between the inertial and unbalance components of torque).

If the drum inertia is known before unbalance detection is carried out, the problem described above can be eliminated by compensating the drum torque for inertia. Assume for the moment that the drum inertia is known before unbalance detection is carried out. This being the case, the constant speed fixed axis model can be written as:

$$\tau_{d_comp} = m_u \cdot g \cdot r_u \cdot \cos(\alpha) \cdot \cos(\theta_d - \phi_u) + \tau_{mean}$$

where $\tau_{d_comp} = \tau_d - J_d \cdot p(\omega_d)$

Therefore, if the drum inertia is known, the inertial torque ripple can be subtracted from the overall ripple so that the input to the estimator is just simply the torque ripple due to gravity acting on the unbalance mass, plus the mean. Expanding the $\tau_{d_comp}$ gives:

$$\tau_{d_comp} = m_u \cdot g \cdot r_u \cdot \cos(\alpha) \cdot \cos(\phi_u)\cos(\theta_d) + m_u \cdot g \cdot r_u \cdot \cos(\alpha) \cdot \sin(\phi_u)\sin(\theta_d) + \tau_{mean}$$

The above equation can be written in the following form suitable for Parameter Estimators such as the RLS estimator:

$$y = x^T\theta$$

where:

$$y = \tau_{d_comp}$$

$$x^T = [1 \ \cos\theta_d \ \sin\theta_d]$$

$$\theta = \begin{bmatrix} \tau_{mean} \\ m_u \cdot g \cdot r_u \cdot \cos\alpha \cdot \cos\phi \\ m_u \cdot g \cdot r_u \cdot \cos\alpha \cdot \sin\phi \end{bmatrix} = \begin{bmatrix} P_1 \\ P_2 \\ P_3 \end{bmatrix}$$

and $P_{1-3}$ are the parameters, or coefficients, estimated by the PE.

It can be seen from the parameter matrix, θ, that further manipulation of $P_2$ and $P_3$ is required to extract the peak torque ripple and the torque ripple phase lag. This is done as follows:

$$\phi_u = \tan^{-1}\left(\frac{P_3}{P_2}\right)$$

$$m_u = \frac{P_3}{g \cdot r_u \cdot \cos\alpha \cdot \sin\phi_u} \text{ or } \frac{P_2}{g \cdot r_u \cdot \cos\alpha \cdot \cos\phi_u}$$

If the acceleration is calculated from drum position, rather than speed, it is essential that the drum position be filtered. The reason for this is that the acceleration is obtained by differentiating the drum position twice. A small amount of noise on the drum position signal could result in very noisy acceleration data, which could in turn affect the accuracy of the estimated parameters. (However, if the speed is known the problem is not as severe because only one differentiation is required to calculate the acceleration; drum position in this case is determined by integrating the speed.)

Being a sawtooth waveform, the drum position signal contains high frequency components not associated with noise. Therefore, applying a low pass filter directly to the drum position signal will distort it significantly. To avoid these problems the sine and cosine of the signal is filtered and then the filtered drum position is reconstructed as follows:

$$\theta_{\text{d_filtered}} = \tan^{-1}\left(\frac{(\sin\theta_d)_{filtered}}{(\cos\theta_d)_{filtered}}\right)$$

Figure 12:
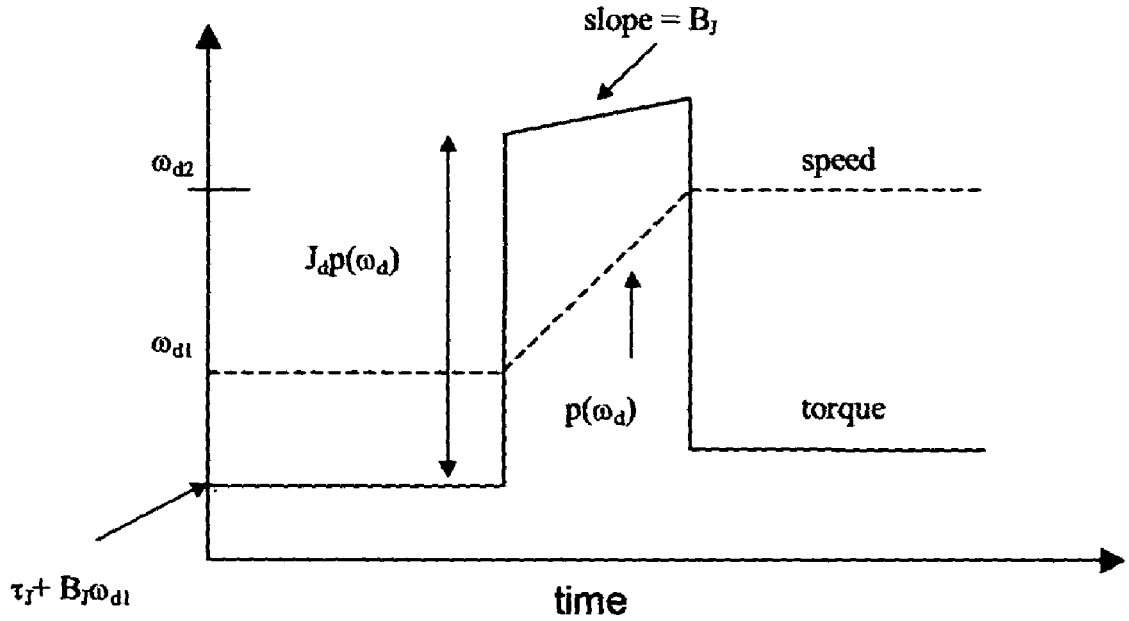
FIG. 12 illustrates torque and speed profiles resulting from accelerating a washing machine drum from a first speed to a second speed for determining drum inertia in accordance with aspects of the present invention.

In the embodiment described above, the drum inertia is calculated prior to the unbalance determination. One method of calculating the inertia is to ramp the drum speed from one predetermined speed to another, for example, 100 rpm to 200 rpm, and feed the resulting data into a parameter estimator with $J_d$ as a tractable parameter. The torque and speed profiles will then look as shown in FIG. 12, which assumes a linear ramp in speed (though a linear ramp is not a requirement). Note that for reasons of clarity, FIG. 12 does not illustrate the torque or speed ripple.

In accelerating from $\omega_{d1}$ to $\omega_{d2}$, it is likely that the suspension will start to affect the mean torque and torque ripple. However, these suspension effects are not taken into account by the fixed axis model given by Equation 2. In calculating the inertia only, the change in torque ripple due to suspension effects is not of much importance. However, the change in mean torque as the speed is increased will affect the inertia calculation, but can be modeled as an additional viscous friction term, $B_s$, if it is assumed that the change in mean torque between $\omega_{d1}$ to $\omega_{d2}$ is a reasonably linear function of speed. Moreover, this additional viscous term can be lumped together with the actual viscous friction term.

Assuming that the mean torque varies linearly with speed between $\omega_{d1}$ and $\omega_{d2}$, the profile shown in FIG. 12 can be modeled using the following equation:

$$\tau_d = J_d p(\omega_d) + B_J \omega_d + \tau_J \tag{13}$$

where $B_J = B_s + B_d$ and $\tau_J \neq \tau_c$

Although torque ripple is not that important as far as estimating inertia is concerned—at least when using a speed profile such as that in FIG. 12—better results will be achieved from a Parameter Estimator if a sinusoidal torque ripple component is included in the model. The reason for this is that the Parameter Estimator may initially perceive the torque ripple as being a sinusoidal variation in mean torque. The torque ripple component will be of the same form as that of the fixed axis model. Therefore, with torque ripple included the inertia model becomes:

$$\tau_d = J_d p(\omega_d) + B_J \omega_d + \tau_J + A \cdot \cos\theta_d + B \cdot \sin\theta_d \tag{14}$$

where A and B are constants. Re-arranging Equation 14 into the form $y = x^T\theta$ for parameter estimation yields:

$$y = \tau_d$$

$$x^T = [p(\omega^d)\ \omega_d\ 1\ \cos\theta_d\ \sin\theta_d]$$

$$\theta = \begin{bmatrix} J_d \\ B_J \\ \tau_J \\ A \\ B \end{bmatrix} = \begin{bmatrix} P_1 \\ P_2 \\ P_3 \\ P_4 \\ P_5 \end{bmatrix}$$

$P_{1-5}$ are the parameters estimated by the parameter estimator. If the drum moves on its suspension significantly the torque ripple will change and so, therefore, will the A and B coefficients. As a result the estimator parameters P4 and P5 will also change in an attempt to track the changes in A and B. This is acceptable because in this particular embodiment only the inertia parameter $P_1$ is required and this is not affected significantly by a gradual change in torque ripple when using a speed profile such as that in FIG. 11. The inertia is therefore directly accessible and is simply the parameter $P_1$.

Figure 13:
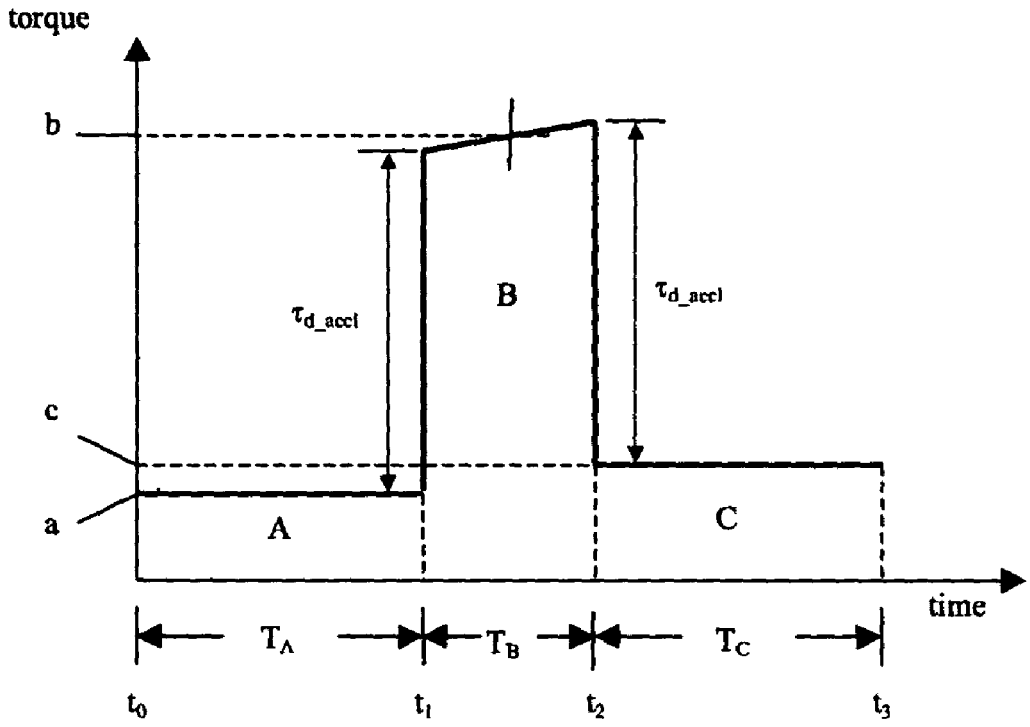
FIG. 13 illustrates a torque profile resulting from accelerating a washing machine drum from a first speed to a second speed for determining drum inertia in accordance with further aspects of the present invention.

In another exemplary embodiment of the invention, an alternative inertia calculation is employed that requires the drum be linearly accelerated from a first predetermined speed to a second higher speed, but does not require the use of a parameter estimator. As noted above, at around minimum plaster speed there is very little suspension movement and one can assume a fixed axis model. However, as the drum is accelerated beyond the minimum plaster speed, the effects of the suspension will become noticeable If the ripple component of the torque waveform is removed, the resulting trace looks something like that shown in FIG. 13. The main quantity of interest in FIG. 13 is the step increase in torque at the onset of acceleration (or the step decrease in torque at the end of acceleration), $\tau_{d_accl}$. Once $\tau_{d_accl}$ is determined, the drum inertia, $J_d$, can then be calculated as follows:

$$J_d = \frac{\tau_{\text{d_accl}}}{p(\omega_d)}$$

The calculation of $\tau_{d_accl}$ follows. The torque trace in FIG. 13 is split up into three distinct regions: A, B and C. The average torque in each of these regions is given by a, b and c, which are calculated as follows:

$$a = \frac{1}{T_A}\int_{t_0}^{t_1} \tau_d\, dt$$

$$b = \frac{1}{T_B}\int_{t_1}^{t_2} \tau_d\, dt$$

-continued $$c = \frac{1}{T_C}\int_{t_2}^{t_3} \tau_d \, dt$$

The acceleration torque is then given by:

$$\tau_{d_accl} = b - \frac{(c+a)}{2}$$

The above method is still applicable with torque ripple present provided that each region contains an integer number of ripple cycles. The periods $T_A$, $T_B$ and $T_C$ must therefore be chosen carefully to ensure this is the case. However, the greater the number of ripple cycles in each region there are, the less critical it is to have an integer number of cycles.

FIG. 13 shows the torque trace with the ripple component removed. This method is applicable with torque ripple present, provided that each region contains an integer number of ripple cycles. The periods $T_A$, $T_B$ and $T_C$ must therefore be chosen carefully to ensure this is the case. However, the greater the number of ripple cycles in each region there are, the less critical it is to have an integer number of cycles.

The processor implementation for an exemplary embodiment is detailed below. Discretising the integration process yields the following equations for a, b and c:

$$a = \frac{T_s}{T_A}\cdot\sum_{n=1}^{(t_1-t_0)/T_s} \tau_{d(n)}$$

$$b = \frac{T_s}{T_B}\cdot\sum_{n=1}^{(t_2-t_1)/T_s} \tau_{d(n)}$$

$$c = \frac{T_s}{T_C}\cdot\sum_{n=1}^{(t_3-t_2)/T_s} \tau_{d(n)}$$

The acceleration torque is therefore given by:

$$\tau_{d_accl} = T_s\cdot\left(\frac{1}{T_B}\cdot\sum_{n=1}^{(t_2-t_1)/T_s}\tau_{d(n)} - \frac{1}{2\cdot T_A}\cdot\sum_{n=1}^{(t_1-t_0)/T_s}\tau_{d(n)} - \frac{1}{2\cdot T_C}\cdot\sum_{n=1}^{(t_3-t_2)/T_s}\tau_{d(n)}\right)$$

The inertia (kg.m$^2$) is then given by:

$$J_d = \frac{T_s\cdot\left(\frac{1}{T_B}\cdot\sum_{n=1}^{(t_2-t_1)/T_s}\tau_{d(n)} - \frac{1}{2\cdot T_A}\cdot\sum_{n=1}^{(t_1-t_0)/T_s}\tau_{d(n)} - \frac{1}{2\cdot T_C}\cdot\sum_{n=1}^{(t_3-t_2)/T_s}\tau_{d(n)}\right)}{p(\omega_d)}$$

In some applications it may be possible to accelerate the drum from $\omega_{d1}$ to a suitably higher speed, $\omega_{d2}$, without exciting the suspension significantly—particularly if $\omega_{d1}$ is set to be the minimum plaster speed. If this is the case then another embodiment of the invention is possible whereby the inertia and unbalance mass can be calculated simultaneously, thus eliminating the need to calculate inertia and mass independently as described in the above embodiment. There is also no need to perform inertia compensation. In this embodiment the generalized fixed axis model given by equation 3 can be assumed. Expanding the cos term in equation 3 yields:

$$\tau_d = m_u\cdot g\cdot r_u\cdot\cos(\alpha)\cdot\cos(\phi_u)\cdot\cos(\theta_d) + m_u\cdot g\cdot r_u\cdot\cos(\alpha)\cdot\sin(\phi_u)\cdot\sin(\theta_d) + J_d\cdot p(\omega_d) + B_d\cdot\omega_d + \tau_c\,\mathrm{signum}(\omega_d) \quad (15)$$

It will be noticed that Equation 15 is of the same form as the inertia model given by Equation 14, with $A = m_u\cdot g\cdot r_u\cos(\alpha)\cdot\cos(\phi_u)$ and $B = m_u g\cdot r_u\cdot\cos(\alpha)\cdot\sin(\phi_u)$. Essentially, this embodiment uses the same procedure as calculating the inertia using a Parameter Estimator in the previous embodiment, except that in addition to calculating inertia, the unbalance mass can be extracted from the A and B parameters because the axis of the drum essentially remains fixed. The method for calculating $m_u$ from A and B above is the same method as that described in the second half of the previous embodiment.

Figure 14:
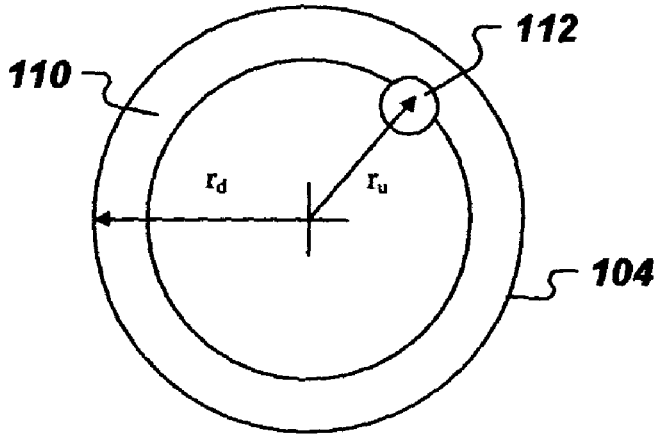
FIG. 14 conceptually shows a washing machine drum containing laundry and an unbalance mass.

As noted above, peak inertial torque ripple will be determined by $J_d$ for a given speed ripple, and the gravitational torque ripple will be determined by $m_u$ assuming that $r_u$ can be calculated before hand. FIG. 14 conceptually shows a washing machine drum 104 containing laundry 110 and an unbalance mass 112. In calculating the unbalance radius $r_u$, it is assumed that the laundry 110 is distributed as shown in FIG. 14 with the unbalance 112 acting at the inner radius formed by the evenly distributed laundry 110.

The inertia of the laundry 110 can be calculated by subtracting the empty drum inertia from $J_d$:

$$J_l = J_d - J_{empty_drum}$$

The inertia of the laundry will be approximately equal to:

$$J_l = \frac{m_l}{2}(r_d^2 + r_u^2)$$

where $m_l$ is the laundry mass.

The volume of the laundry is approximately equal to:

$$V_l = l\pi(r_d^2 - r_u^2)$$

where 'l' is the length of the drum. Assuming a figure for the density of modern fabrics, $D_l$, the mass of the laundry can be written as:

$$m_l = D_l V_l$$

$r_u$ is therefore given by the following equation $$r_u = \sqrt[4]{r_d^4 - \frac{2J_1}{D_1 l\pi}}$$

(It is anticipated that $D_l$ will depend upon the type of laundry to be washed, e.g. synthetics, woolens, etc. will each have its own density)

In another embodiment of the present invention, the problem of having an "insufficiently excited" system is solved by introducing a "dither" signal to sufficiently excite all modes of the system. In the context of the system under investigation, this involves adding a signal to the speed command signal 202 such that the actual drum speed fluctuates around a mean value in a deterministic manner.

One requirement of the dither signal is that it should be of reasonably small amplitude so that the drum speed does not deviate too much from its mean value. Another requirement of the signal is that it should not excite any system resonances that could result in excessive vibration.

As described above, one of the reasons why the inherent speed ripple is unsuitable is because its frequency is equal to that of the mean drum speed. For low values of speed ripple, this means that the unbalance torque and inertial torque are both approximately sinusoidal at the same frequency and the parameter estimator could therefore have difficulty in distinguishing between the two torque components. However, if the drum ripple contained frequency components of a different frequency to that of the mean drum speed, the unbalance and inertial components of torque would also differ in frequency and would therefore be more easily identifiable by the parameter estimator.

One of the benefits of using a dither signal to excite the system over the embodiments described previously is that unbalance mass and inertia can be calculated simultaneously at a substantially constant drum speed. Therefore, during unbalance detection the mean drum speed can be fixed at a speed to allow the use of the fixed axis model given by Equation 3, or if torque ripple due to viscous friction is assumed negligible, Equation 12 may be used. No particular form of dither signal is required, though in certain implementations, a 1 Hz sinusoidal dither signal with an amplitude of about 0.2 rad/s was used with satisfactory results.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A motor control device for determining a load unbalance mass contained in a spinning washing machine drum driven by the motor, the motor control device comprising:

a processor; and a memory accessible by the processor and storing a mathematical model of the washing machine drum load describing the relationship between motor torque and the load unbalance mass, wherein coefficients of the mathematical model are determined using a parameter estimator;

the processor configured to determine a motor torque ripple;

determine a motor speed;

determine a washing machine drum angular position;

determine the load unbalance mass based on the motor torque ripple and motor speed; and determine a combined inertia of the washing machine drum and the unbalance mass.

2. The motor control device of claim 1, further configured to determine the motor voltage and current.

3. The motor control device of claim 1, further configured to run the motor through a predetermined speed profile.

4. The motor control device of claim 1, further configured to run the motor at a first predetermined speed and to accelerate the motor to a second predetermined speed.

5. The motor control device of claim 1, further configured to run the motor at a predetermined speed for a predetermined time period.

6. The motor control device of claim 1, further configured to fluctuate the motor speed about a predetermined speed value.

7. The motor control device of claim 6, further configured to apply a speed demand signal to a speed controller and to apply a dither signal to the speed demand signal.

8. The motor control device of claim 1, further configured to determine the motor torque and speed at a plurality of sample points.

9. The motor control device of claim 1, further configured to determine the motor acceleration.

10. The motor control device of claim 1, further configured to determine the washing machine drum angular position based on the motor speed.

11. The motor control device of claim 1, wherein the processor is further configured to determine the load unbalance mass when the washing machine drum is spinning at or above the minimum plaster speed.

12. A clothes washing machine system, comprising:

a cabinet;

a drum rotatably mounted within the cabinet;

a motor operably coupled to the drum for rotating the drum within the cabinet; and a motor control device comprising a processor; and a memory accessible by the processor and storing a mathematical model of the washing machine drum load describing the relationship between motor torque and the load unbalance mass, wherein coefficients of the mathematical model are determined using a parameter estimator;

the processor configured to determine a motor torque ripple;

determine a motor speed;

determine a washing machine drum angular position;

determine the load unbalance mass based on the motor torque ripple and motor speed; and determine a combined inertia of the washing machine drum and the unbalance mass.

13. The clothes washing machine system of claim 12, further comprising a device for measuring the drum rotation speed.

14. The clothes washing machine system of claim 12, wherein the motor control device is further configured to determine the motor current and voltage, and to determine the washing machine drum angular position based on the motor current and voltage.

15. The clothes washing machine system of claim 12, wherein the motor control device is further configured to compensate the determined motor torque for the combined inertia.

* * * * *